US008596000B2

(12) United States Patent
Mitchell et al.

(10) Patent No.: US 8,596,000 B2
(45) **Date of Patent: *Dec. 3, 2013**

(54) INTERLOCKING PANEL SYSTEM

(71) Applicant: Royal Group, Inc., Woodbridge (CA)

(72) Inventors: Stephen A. Mitchell, Chilhowie, VA (US); Brian L. Stafford, Bristol, VA (US); Noel E. King, Chilhowie, VA (US); Rodney L. Olinger, Saltville, VA (US)

(73) Assignee: Royal Group, Inc., Woodbridge (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/847,087

(22) Filed: Mar. 19, 2013

(65) Prior Publication Data

US 2013/0212969 A1 Aug. 22, 2013

Related U.S. Application Data

(63) Continuation of application No. 12/750,065, filed on Mar. 30, 2010, now Pat. No. 8,402,707.

(60) Provisional application No. 61/299,383, filed on Jan. 29, 2010.

(51) Int. Cl.
*E04F 13/073* (2006.01)
*E04F 13/076* (2006.01)

(52) U.S. Cl.
USPC ..... 52/288.1; 52/536; 52/547; 52/573.1

(58) Field of Classification Search
USPC ..... 52/287.1, 288.1, 478, 536–539, 547, 52/573.1, 592.1, 592.2
See application file for complete search history.

(56) References Cited

U.S. PATENT DOCUMENTS

| | | | | | |
|---|---|---|---|---|---|
| 367,758 | A * | 8/1887 | Jungst | 52/537 |
| 637,212 | A * | 11/1899 | McCune | 52/284 |
| 973,946 | A * | 10/1910 | Lindau | 52/538 |
| 1,343,792 | A * | 6/1920 | Schmitte | 52/536 |
| 1,823,039 | A * | 9/1931 | Gruner | 52/592.4 |
| 2,200,649 | A * | 5/1940 | Wardle | 52/489.2 |
| 3,304,676 | A * | 2/1967 | Sallie et al. | 52/276 |
| 3,421,517 | A * | 1/1969 | Sabel | 36/142 |
| 3,593,479 | A * | 7/1971 | Hinds et al. | 52/313 |
| 3,738,076 | A * | 6/1973 | Kessler | 52/547 |
| 5,224,318 | A * | 7/1993 | Kemerer | 52/521 |
| 5,249,402 | A * | 10/1993 | Crick et al. | 52/533 |
| 5,347,784 | A * | 9/1994 | Crick et al. | 52/520 |
| 5,581,968 | A * | 12/1996 | Laurie et al. | 52/538 |
| 5,671,577 | A * | 9/1997 | Todd | 52/519 |
| 6,367,220 | B1 * | 4/2002 | Krause et al. | 52/512 |
| 6,715,250 | B2 * | 4/2004 | Bryant et al. | 52/528 |
| 7,698,864 | B2 * | 4/2010 | Justice et al. | 52/519 |
| 2009/0038247 | A1 * | 2/2009 | Taylor et al. | 52/287.1 |
| 2010/0058691 | A1 * | 3/2010 | Mannion | 52/309.3 |

FOREIGN PATENT DOCUMENTS

JP 6-1313344 * 11/1994

* cited by examiner

*Primary Examiner* — Robert Canfield
(74) *Attorney, Agent, or Firm* — Hunton & Williams LLP

(57) ABSTRACT

A panel system includes elongated panels coupled together at a seam portion with respective interlocking portions at corresponding vertical ends to provide a substantially planar surface. In siding panel systems, joined siding panels are provided in vertically arranged rows that further couple together along adjacent horizontal edges of the respective rows of siding panels.

14 Claims, 6 Drawing Sheets

INTERLOCKING PANEL SYSTEM

CROSS-REFERENCE TO RELATED APPLICATION

The present application is a continuation of U.S. application Ser. No. 12/750,065 filed on Mar. 30, 2010, now U.S. Pat. No. 8,402,707 issued Mar. 26, 2013, which claims the benefit of priority of U.S. Provisional Application No. 61/299,383 filed Jan. 29, 2010, which are incorporated herein by reference.

BACKGROUND

1. Field of the Art

The present invention relates to panel systems, such as generally flat sections used in building, construction and other applications, including in walls, siding, flooring, tiling, shelving, furniture and like. In non-limiting embodiments the present invention provides a system of interlocking siding panels and a method of making interlocking siding panels.

2. Description of Related Art

Vinyl and metal siding panels, such as those used to cover the exterior of a building, generally are formed as single lap panels that extend horizontally across the building. In cases where a single panel is not long enough to extend across an entire surface of a building, multiple panels may be positioned horizontally adjacent to one another. Horizontally adjacent siding panels may overlap one another, such as when the siding panels are thin or hollow, or may be fastened with their ends in an abutting arrangement such as with a bracket or shim.

Once installed, the siding panels may tend to expand or contract horizontally (horizontally) as the ambient temperature changes. This expansion and contraction may cause irregularities in the seam section between two adjacent panels. For example, if adjacent abutting panels expand, the ends of the adjacent panels may expand toward each other, causing them to deflect away from the building at the seam section. If adjacent abutting panels contract, the ends of the panels may draw away from each other, resulting in a gap at the seam section. The gapping created by expansion or contraction of the siding panels may leave openings that can be unsightly, and leave the siding and building surface susceptible to damage from the elements.

In siding panel assemblies having overlapping end portions, the overlapping portion typically is left unfastened, so that the individual panels may expand and contract without causing bulging or gapping. However, the overlapping region leaves an undesirable visible seam. In addition, the gap between the two overlapping sections allows water, air, and insects to pass which may cause damage to the siding panels or the underlying building surface. Furthermore, where the overlapping region is unfastened, the ends of the siding panels can separate, further exacerbating these issues.

In siding panel assemblies having abutting siding panels, additional connectors and similar devices have been used to prevent movement and separation of the ends of the siding panels. However, the use of separate connector pieces complicates the installation and assembly of the siding panels.

The description herein of certain advantages and disadvantages of known methods and devices is not intended to limit the scope of the present invention. Indeed, the present embodiments may include some or all of the features described above without suffering from the same disadvantages.

SUMMARY

In view of the foregoing, it is a feature of the embodiments described herein to provide a system of panels that provides an improved end-to-end seam section with the outer surfaces of the joined panels providing a generally planar surface. In various embodiments, adjacent panels in a siding system may overlap and interlock at a seam section in a secure fashion. Once interlocked, the siding panels may expand and contract without causing a bulge or gap at the seam section. One benefit of siding panel assembly may be that the expansion and contraction associated with the individual siding panels is transferred to the ends of the assembly, rather than the end of each individual siding panel. Another benefit of the siding panel assembly of the embodiments is that it allows for a smoother seam between individual panels, so that it is less apparent from all viewing angles, unlike vinyl siding where the pieces are overlapped, to allow for expansion and contraction.

In one embodiment, a panel system, such as but not limited to a building exterior siding panel system, has first and second elongated panels joined at adjacent vertical ends with outer faces of the panels together providing a substantially planar surface with a seam portion. The first elongated panel includes an integrally formed first interlock at the seam portion, and the second panel has a corresponding integrally formed second interlock at the seam portion.

In one embodiment of the invention, the first and second elongated panels overlap at the seam portion. In further embodiments, the first interlock is formed in a surface of said first panel opposite the first panel's outer face and the second interlock is formed in a surface of said second panel overlapped by the first interlock.

In one embodiment of the invention, the first interlock has a first interlock projection and the second interlock has a corresponding second interlock receiving groove into which the projection couples. In other embodiments, the first interlock also includes a first interlock receiving groove and the second interlock also includes a corresponding second interlock projection such that each interlock's respective projection is received into the other interlock's groove.

In another embodiment, an interlock projection and corresponding interlock groove have a friction fit.

In various embodiments panels of the invention comprise a wide variety of non-limiting materials including polymers, plastics, metals, woods, composites, masonry, plaster, concrete, brick, stone, and the like. In one embodiment of the invention, panels comprise cellular polyvinylchloride.

In embodiments of the invention having siding panels in a siding panel system, a plurality of rows are aligned one above the other with each row comprised of interlocking siding panels of the invention. An exemplary embodiment of a multi-row siding system includes an upper row of siding including at least a pair of siding panels forming an elongated substantially planar surface with a bottom horizontal edge and a lower row of siding including at least a pair of siding panels forming an elongated substantially planar surface with a top horizontal edge abutting the bottom horizontal edge along the length of each row. In the exemplary embodiment, each pair of siding panels of each of said upper and lower rows further includes first and second elongated siding panels joined at adjacent vertical ends to form a seam portion, wherein said first elongated siding panel has an integrally formed first interlock at said seam portion and said second siding panel has a corresponding integrally formed second interlock at said seam portion.

In other embodiments of the invention, a panel system, including for instance siding panels, may include a decorative cover that covers a vertical end of at least one of panel.

BRIEF DESCRIPTION OF THE DRAWINGS

Purposes and advantages of the exemplary embodiments will be apparent to those of ordinary skill in the art from the following detailed description in conjunction with the appended drawings in which like reference characters are used to indicate like elements, and in which.

Figure 1:
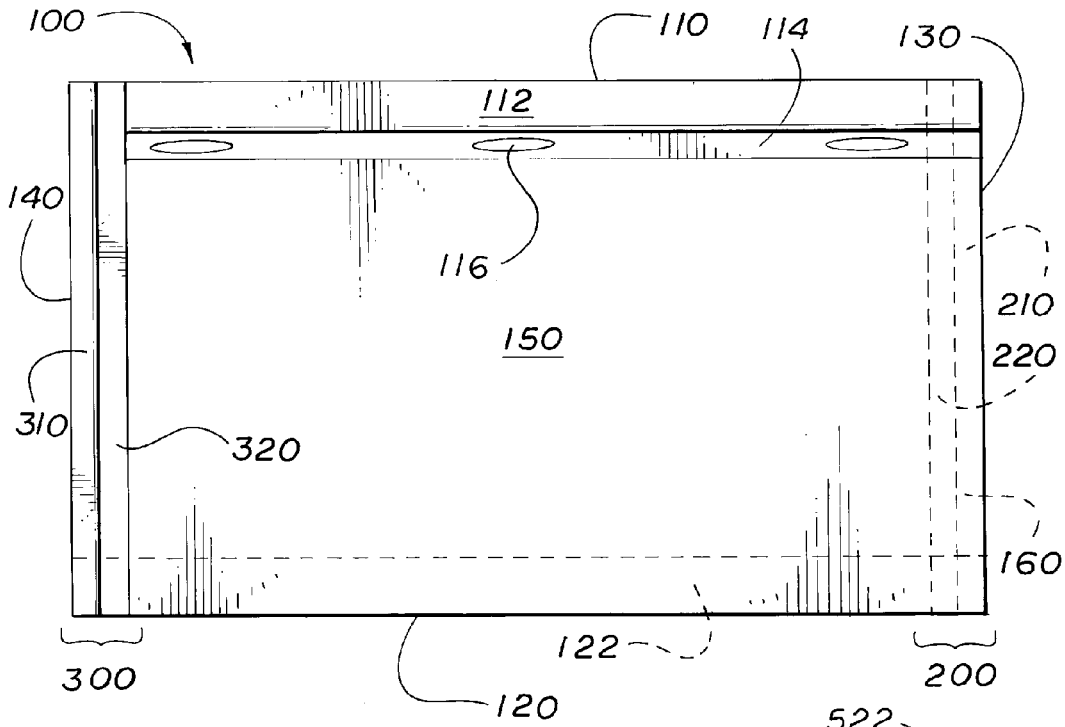
FIG. 1 is a plan view of a siding panel, according to an exemplary embodiment.

These and other exemplary embodiments and advantages will become apparent from the following detailed description, taken in conjunction with the accompanying drawings, illustrating by way of example the principles of the various exemplary embodiments.

DETAILED DESCRIPTION OF PREFERRED EMBODIMENTS

The following description is intended to convey a thorough understanding of the embodiments by providing a number of specific embodiments and details involving a siding panel assembly. It is understood, however, that the invention is not limited to these specific embodiments and details, which are exemplary only. It is further understood that one possessing ordinary skill in the art, in light of known devices, systems and methods, would appreciate the use of the invention for its intended purposes and benefits in any number of alternative embodiments.

Generally speaking, panel systems of the present invention are generally flat sections used in building, construction and other applications, including in walls, siding, flooring, tiling, shelving, furniture and like. In one described but non-limiting embodiment, a panel system of the invention includes siding panels that have a plurality of horizontally adjacent siding panels that are interlocked on their vertical ends to provide a composite siding panel. The siding panels are joined together so that the composite siding panels form a single unit, such as in a row with outer-facing surfaces of the siding panels providing an exterior siding surface of building in which a row of siding panels substantially forms a planar surface. Any horizontal expansion or contraction of the individual siding panels is transferred to the end of the composite panel, rather than causing gapping or buckling at the junction between two adjacent panels. These composite siding panels may be assembled in horizontal rows, adjacent other composite siding panels along respective horizontal edges of the adjacent rows, to form a siding panel assembly that covers a surface, such as the wall of a building. As used herein, the terms "horizontal" and "vertical" are not intended to be limited to a specific orientation and reflect generally perpendicular sides, edges or ends with respect to one another. The references of "horizontal" and "vertical" as describing one embodiment of the invention are intended to continue to reference the respective edge, side or end in other embodiments where a panel or panel system is provided in another orientation relative to the ground or horizon.

In the various exemplary embodiments, the siding panel assemblies and their components may be made from solid or foamed polymers, such as vinyl or cellular PVC. However, the embodiments are not so limited. The siding panel assemblies and their components may be made from any known or later developed material used for siding panels including, but not limited to, wood, aluminum, steel and other metals, polymer materials, plastics, masonry, stone, brick, concrete, composites and combinations thereof. Panels of various materials may be shaped by extrusion, milling, molding, and the like. One having ordinary skill in the art would understand how to apply the teachings of various materials and panel manufacturing methods to various embodiments of the invention.

Referring to FIG. 1, in an exemplary embodiment an individual siding panel 100 is a generally elongated and planar and substantially flat. The siding panel 100 may have first (upper) horizontal edge 110 and a second (lower) horizontal edge 120, and a first end 130 and a second end 140 located at the vertical ends of the siding panel 100. The siding panel 100 may have a first surface 150 that, when the panel 100 is installed, faces outward, and a second surface 160 that faces inward (toward the building surface) when the panel 100 is installed.

In exemplary embodiments, the siding panel 100 may be a single lap panel. However, it will be appreciated that the present embodiments are not limited to being used with single lap panels, and may be used with any type, shape or size siding panel. For example, siding panel 100 may be a double panel or a beaded panel.

Figure 4:
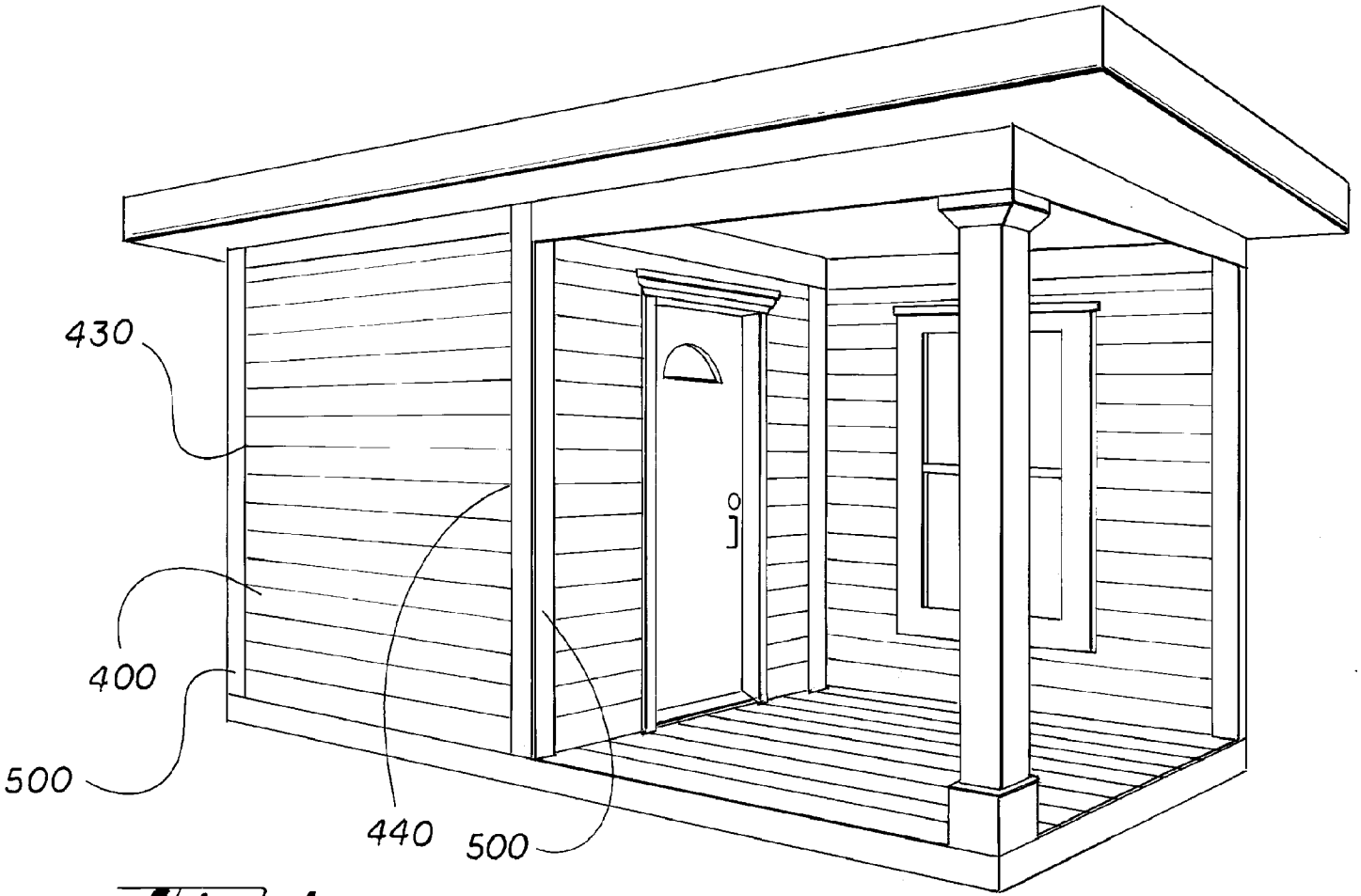
FIG. 4 is a perspective view of a building structure with a siding panel system according to an exemplary embodiment.
Figure 8:
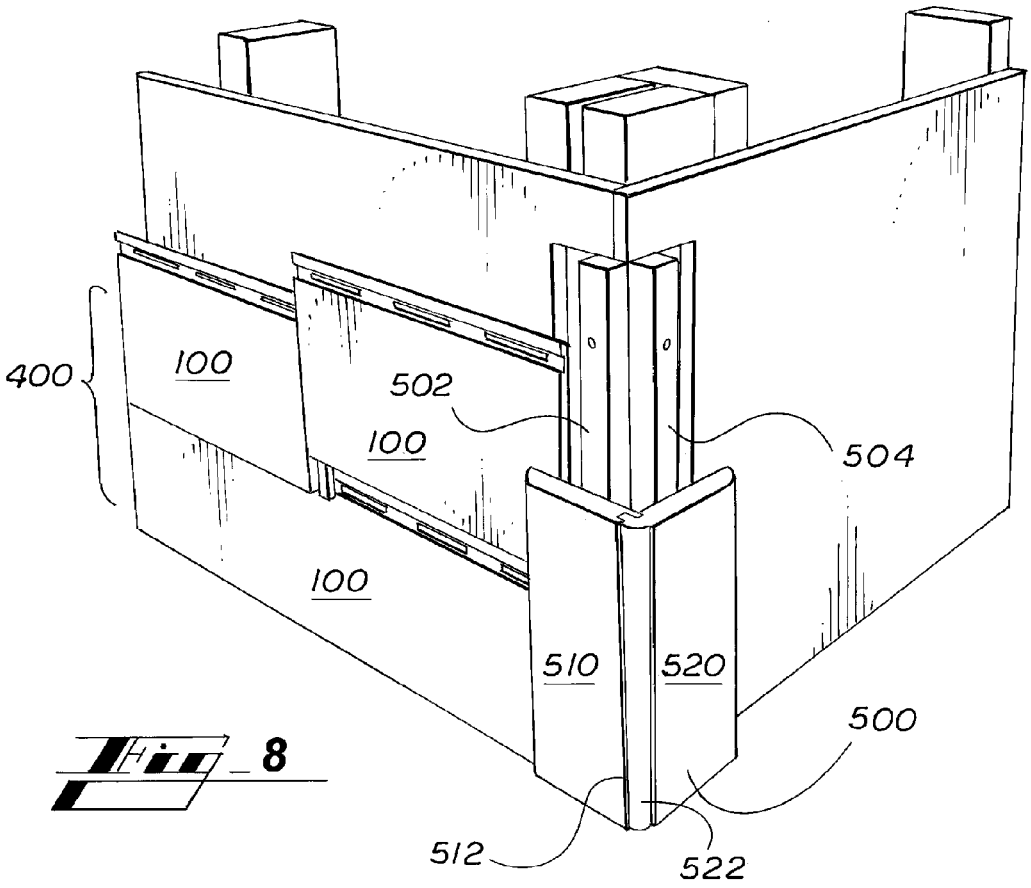
FIG. 8 is a perspective view of a partially-assembled siding panel system and decorative end piece according to an exemplary embodiment.
Figure 10:
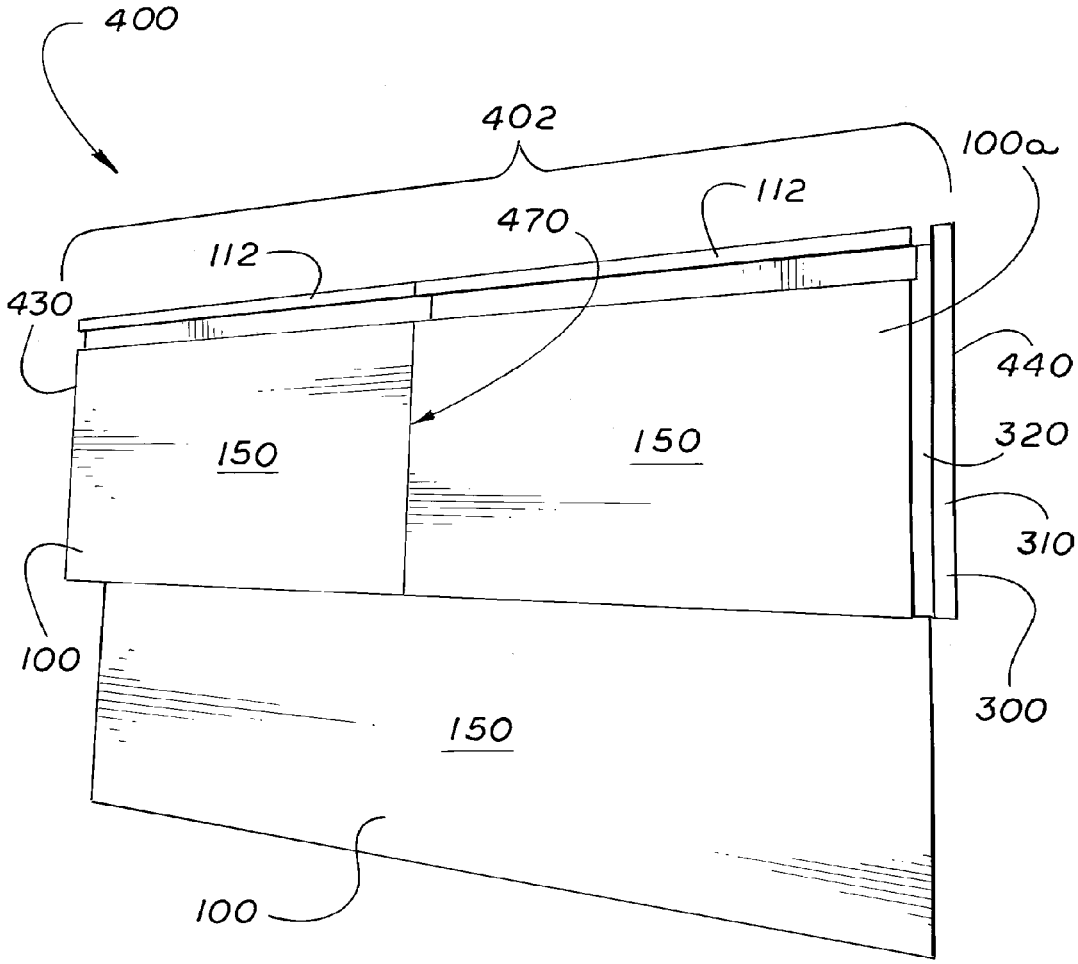
FIG. 10 is a perspective view of a siding panel system according to an exemplary embodiment.

In exemplary embodiments, a plurality of siding panels 100 are combined to provide a siding panel system 400 (FIGS. 4, 8, and 10). The siding panel system 400 comprises a plurality of siding panels 100 extending horizontally along the building surface. The plurality of siding panels 100 are arranged in vertically adjacent rows that extend from the bottom of the building surface to the top of the building surface (or covering a predetermined portion of the building surface). Within a row, where the siding panels 100 are insufficient to extend the full width of the building surface, a plurality of siding panels 100 may be arranged a horizontally adjacent fashion, to cover the width of the building surface (or a predetermined portion of the building surface).

In exemplary embodiments, the siding panel 100 may have a mounting assembly disposed along its first horizontal edge 110 and/or its second horizontal edge 120, so that the siding panel 100 may be fastened to a building surface. For example, a fastening flange 114 may be disposed along the first horizontal edge 110 of siding panel 100. In exemplary embodiments, fastening flange 114 may have a plurality of fastener receiving holes or receiving grooves 116 through which fasteners such as nails or screws may be inserted to fasten the siding panel 100 to an underlying building structure. In various exemplary embodiments, the mounting assembly will allow the siding panel 100 to shift or expand in the horizontal direction when it is mounted.

Figure 5:
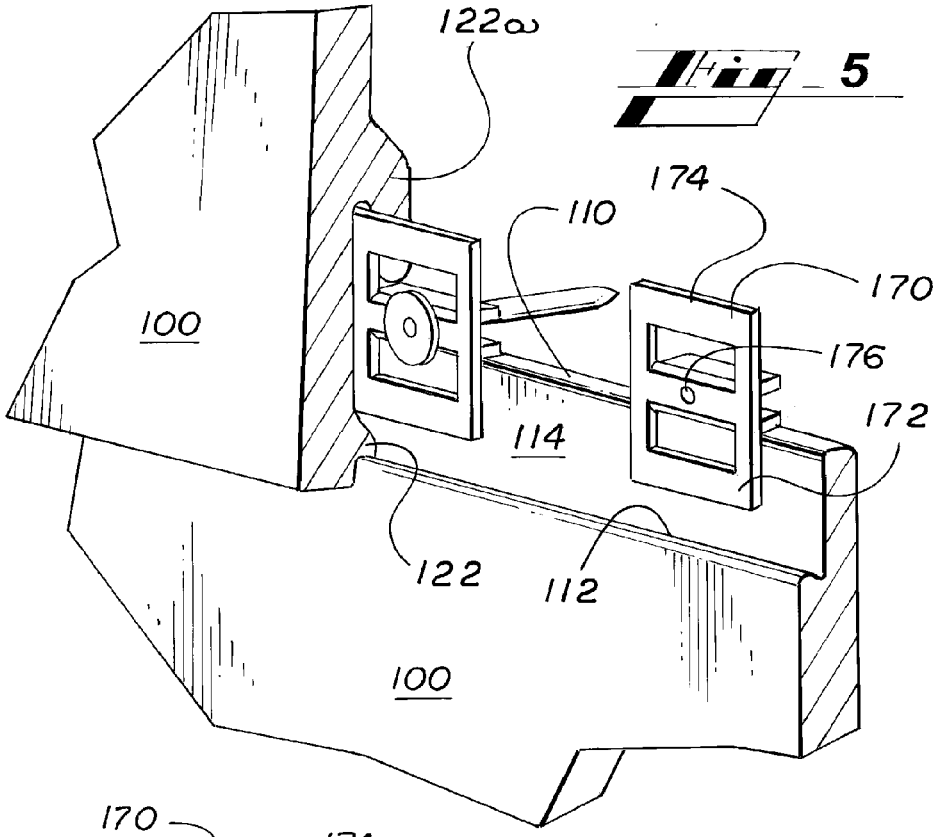
FIG. 5 is a perspective view of a siding panel system according to an exemplary embodiment.
Figure 6A:
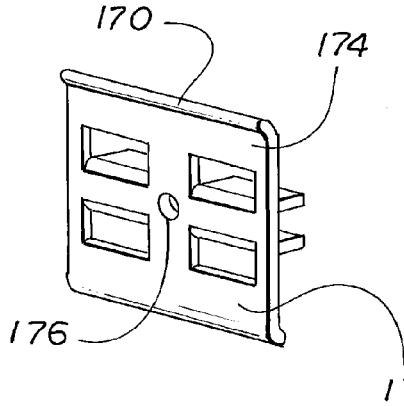
FIGS. 6A and 6B are perspective views of exemplary clip fasteners according to an exemplary embodiment.
Figure 6B:
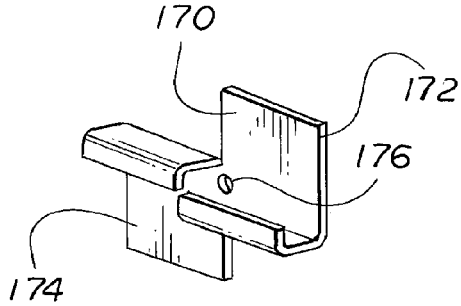

Referring to FIG. 5, in other exemplary embodiments, one or more clip fasteners 170 may be used to fasten the fastening flange 114 to the underlying building surface. An exemplary clip fastener 170 may have a lower flange 172, an upper flange 174, and a fastener receiving hole 176. To fasten a siding panel 100 to an underlying surface, clip fastener 170 may be placed along the first horizontal edge 110 so that the lower flange 172 overlaps the fastening flange 114. A fastener such as a nail or screw may be inserted into the fastener receiving hole 176, to fasten the clip fastener 170 to the underlying surface. When fastened, the clip fastener 170 supports the fastening flange 114 by holding it against the underlying surface, but enables the siding panel 100 to shift or expand in the horizontal direction. It will be appreciated that exemplary clip fasteners 170 may have a variety of shapes, consistent with the function and purpose described herein such as, for example, the fasteners 170 illustrated in FIGS. 6A and 6B.

Figure 2:
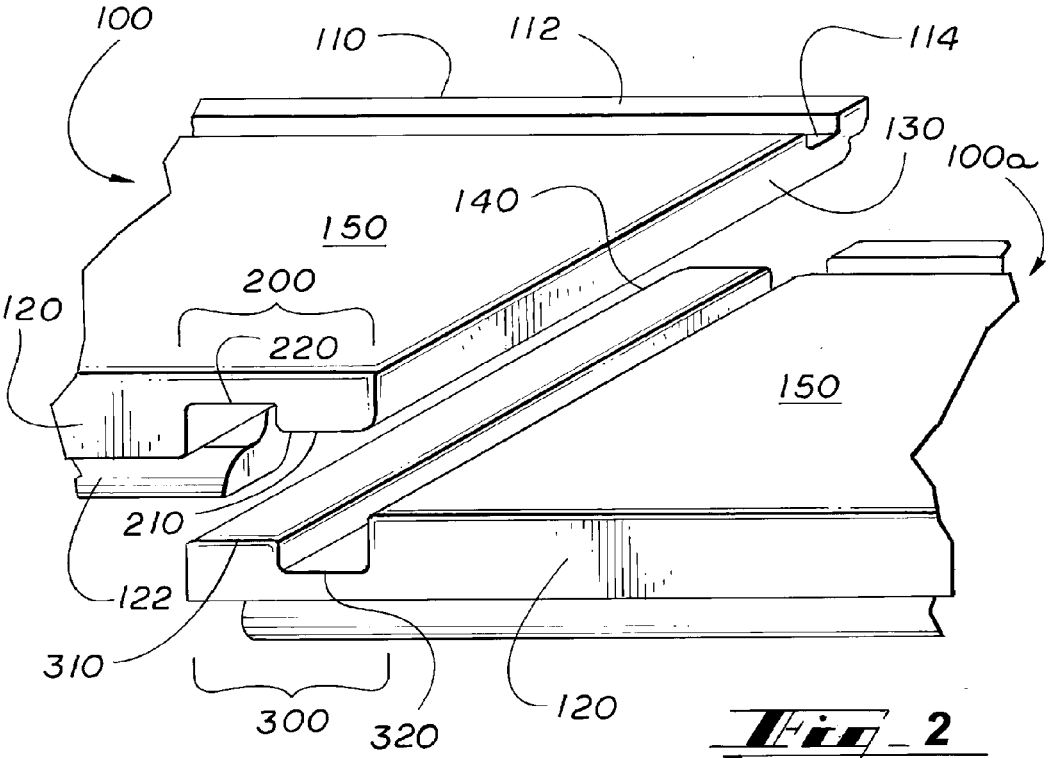
FIG. 2 is a partial perspective view of two horizontally adjacent siding panels, according to an exemplary embodiment.

Referring to FIG. 2, in various exemplary embodiments the siding panel 100 may have a vertical interlock system that aligns vertically adjacent siding panels so that adjacent rows couple along respective horizontal edge lengths. In an exemplary embodiment, siding panel 100 may have an upper vertical interlock 112 disposed on the first horizontal edge 110, that mates with a corresponding lower vertical interlock 122 disposed on the second horizontal edge 120 of a vertically adjacent siding panel 100. For example, lower vertical interlock 122, such as along a bottom horizontal edge of an upper row of siding panels, may comprise a groove or receiving groove that nests with a corresponding lip or flange of the upper vertical interlock 112, such as along a top horizontal edge of an adjacent lower row of siding panels.

In exemplary embodiments, the vertical interlock system may include a plurality of engaged upper vertical interlocks 112 and corresponding lower vertical interlocks 122. Referring to FIG. 5, in another exemplary embodiment, clip fastener 170 may provide a supplemental or alternative vertical interlock system. For example, upper flange 174 of clip fastener 170 may engage with a corresponding lower vertical interlock 122*a* of vertically adjacent side panel 100.

Figure 3:
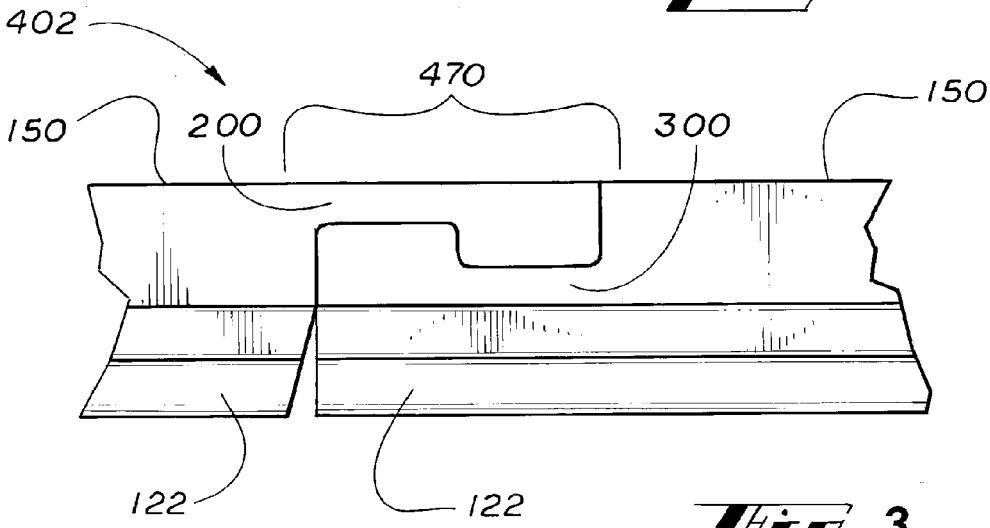
FIG. 3 is a partial bottom edge view of two interlocked horizontally adjacent siding panels, according to an exemplary embodiment.

Referring to FIGS. 2-4, in exemplary embodiments, the siding panel 100 may have a horizontal interlocking system that aligns and fastens horizontally adjacent siding panels 100, 100*a*. (Each of the siding panels 100, 100*a* has identical features, therefore like features of each siding panel have like reference numbers.) In exemplary embodiments, siding panel 100 may have a first horizontal interlock 200 integrally formed in the first end 130 of the panel 100, and a corresponding second horizontal interlock 300 integrally formed in the second end 140 of the siding panel. When siding panels 100 are assembled, the first horizontal interlock 200 engages with the second horizontal interlock 300 of a horizontally adjacent siding panel 100, to securely fasten adjacent siding panels together.

When the first and second horizontal interlocks 200, 300, are engaged, the horizontally adjacent siding panels 100, 100*a* are securely fastened together, and may function as a single unit. In exemplary embodiments a plurality of horizontally adjacent siding panels 100, 100*a* that are fastened together may form a composite panel 402 of siding panel system 400, having a first end 430, a second end 440. At least one seam portion 470 may be formed between horizontally adjacent siding panels 100, 100*a*. In exemplary embodiments, when the siding panels 100, 100*a* expand or contract in the horizontal direction, the seam portion 470 does not buckle, bulge, or separate. Rather, the expansion and contraction of the siding panels 100, 100*a* is apparent only at the first end 430 or second end 440 of the composite siding panel system 400, such as, for example, at the respective ends of a row of the building surface that comprises panel system 400. Furthermore, the expansion of the individual siding panels 100, 100*a* is additive, so that the expansion or contraction of the siding panel system 400 is equal to the sum of the expansion or contraction rate of each of the individual siding panels 100, 100*a*.

With continuing reference to FIGS. 2-3, in various exemplary embodiments, the first and second horizontal interlocks 200, 300, are configured to provide an overlapping arrangement between horizontally adjacent siding panels 100, 100*a*. For example, first horizontal interlock 200 may comprise a first receiving groove 220 and first projection 210 integrally formed in the second surface 160 (such as opposite from surface 150) of the siding panel 100, at the first end 130. Second horizontal interlock 300 may comprise a second receiving groove 320 and second projection 310 integrally formed in the first surface 150 of the siding panel 100, at the second end 140. First projection 210 is configured to nest within second receiving groove 320; and second projection 310 is configured to nest within first receiving groove 220, to provide an overlapping interlocking configuration, at seam portion 470. In exemplary embodiments, the corresponding projections and grooves are configured to provide a friction fit. It will be appreciated from the one embodiment depicted in FIGS. 2 and 3 that that second projection 310 may configured so that it is not co-planar with a substantially planar face of surface 150 so that first projection 210 and the receiving groove 220 couple with second projection 310 and receiving groove 320 to provide a substantially planar and continuous surface of the outer faces of panels 100 and 100*a* in panel system 400.

Figure 7A:
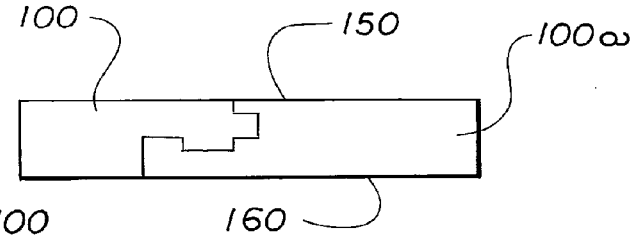
FIGS. 7A and 7B are sectional views of an exemplary horizontal interlock system according to an exemplary embodiment.
Figure 7B:
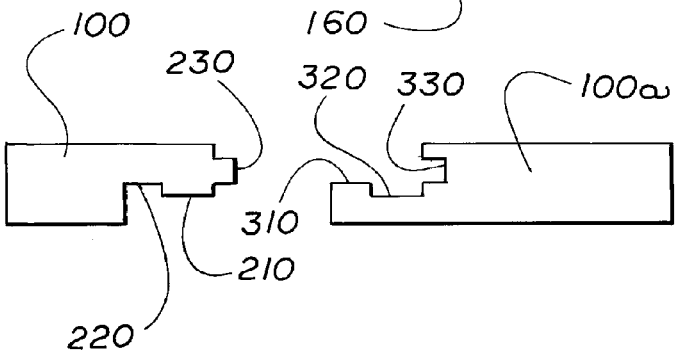

In exemplary embodiments, first and second horizontal interlocks 200, 300, may have a variety of interlocking shapes. For example, referring to FIGS. 7A and 7B, first horizontal interlock 200 may comprise a first receiving groove 220, first projection 210, and an additional projection 230, extending in a direction orthogonal to the first projection 210. Second horizontal interlock 300 may comprise a second receiving groove 320 and second projection 310 and an additional receiving groove 330 adapted to receive the additional projection 230. One having ordinary skill in the art would appreciate the various nesting geometries that may provide a horizontal interlocking system as described herein.

In exemplary embodiments, seam portion 470, i.e. the junction of two horizontally adjacent siding panels 100, 100*a*, may be smooth, with minimal gapping. For example, the first surface 150 of siding panel 100 may generally be coplanar with the first surface 150 of siding panel 100*a*, and there is minimal gapping between the engaged horizontal interlocks 200 and 300. In embodiments in which the seam 470 is smooth, the visibility of the seam may be minimized, so that the composite siding panel system 400 appears as one continuous panel, rather than a plurality of individual panels. In addition, minimizing the gapping between the nested horizontal interlocks 200 and 300 prevents moisture, wind, insects, and the like from penetrating and damaging the composite siding panel system 400.

Referring to FIG. 3, the composite siding panel system 400 of the exemplary embodiments may have a composite upper vertical interlock comprising the upper vertical interlocks 112, 112 of horizontally adjacent siding panels 100, 100*a*; and a composite lower vertical interlock comprising the lower vertical interlocks 122, 122 of horizontally adjacent siding panels 100, 100*a*. In exemplary embodiments, the composite upper and lower interlocks in the seam section 470, aid in locking together horizontally adjacent siding panels 100, 100*a*. For example, because the horizontally adjacent siding panels 100, 100*a* are interlocked in an overlapping fashion, by engaging the upper and lower vertical interlocks the horizontally adjacent siding panels 100, 100*a* are prevented from disengaging at the seam section 470.

In exemplary embodiments, the expansion and contraction of the individual siding panels 100, 100*a* is transferred to the first end 430 and second end 440 of the composite siding panel system 400, as shown in FIG. 4. To hide the movement of the first end 430 or second end 440, the ends of the composite siding panels 400 may be covered by (but not fastened to) a decorative end component 500. For example, referring to FIGS. 4, 8, and 9, the decorative end component 500 may be disposed over a corner junction between two building surfaces. This creates a more aesthetically pleasing look by hiding the cut ends of the siding panels, and hiding the movement of the ends of the siding panel system 400.

Figure 9:
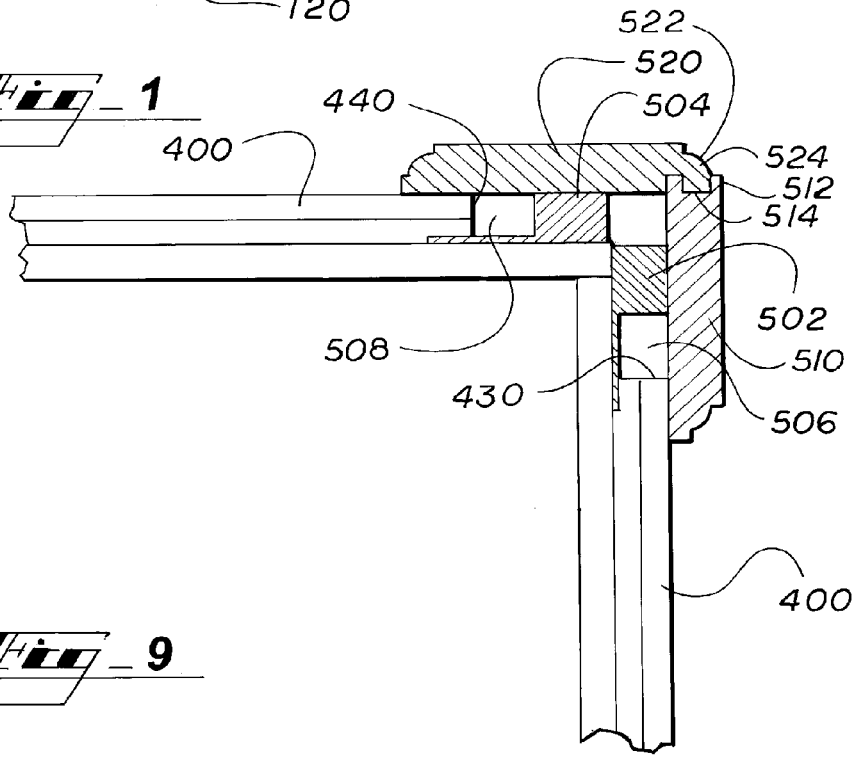
FIG. 9 is a top partial sectional view of a siding panel system and a decorative end piece according to an exemplary embodiment.

In exemplary embodiments, decorative end piece 500 may be a single member, or it may comprise a plurality of members. Referring to FIGS. 8 and 9, exemplary decorative end piece 500 may comprise first corner panel 510 and second corner panel 520 that are operably coupled to form a cover for a corner of a building. First corner panel 510 and second corner panel 520 may be coupled in an orthogonal configuration along their respective adjacent longitudinal edges 512, 522. For example, longitudinal edge 512 may have a groove 514, that is adapted to receive a flange 524 on longitudinal edge 522 of second corner panel 520. It will be appreciated that there are a variety of methods of attaching longitudinal edges 512, 522 to provide decorative end piece 500.

In exemplary embodiments, decorative end piece 500 may be installed over a building surface so that first corner panel 510 and second corner panel 520 overlap the ends 430, 440 of siding panel system 400 without being fastened to them. In some exemplary embodiments, a first spacer 502 may be provided between the building surface and first corner panel 510. First spacer 502 may be configured to position the first corner panel 510 at a predetermined distance from the building surface so that it overlaps the outer surface of a siding panel system 400. First spacer 502 preferably has a depth that is equal to or greater than the largest depth of installed siding panel system 400. First spacer 502 may be a unitary panel, or it may comprise a plurality of elements that serve the same function and purpose described herein. A second spacer 504 may be provided for the second corner panel 520, having the same or similar configuration as described with respect to first spacer 502.

In exemplary embodiments, first spacer 502 and second spacer 504, respectively, may be laterally spaced from the adjacent end of siding panel system 400, to accommodate expansion of siding panel system 400. In exemplary embodiments, a first void 506 may be provided between the first spacer 502 and the end of adjacent siding panel system 400 and a second void 508 may be provided between the second spacer 504 and the end of adjacent siding panel system 400. When siding panel systems 400 and spacers 502 and 504 are initially installed, the first void 506 and second void 508 may have a width of approximately 2.5 inches. The width of first and second voids 506 and 508 may change over time as siding panel systems 400 expand and contract.

In various exemplary embodiments, a method of assembling a siding panel system 400 includes providing a plurality of siding panels 100 with a horizontal interlock system and engaging the horizontal interlock system of two adjacent siding panels 100 to form a composite panel 402, as a part of siding panel system 400. The composite panel 402, may be fastened to a building surface, such as in a planar row, as a part of siding panel system 400. Additional siding panels 100 or composite panels 402 may be installed vertically adjacent to the composite panel 402, to provide siding panel system 400.

In various exemplary embodiments, the siding panel 100 may be formed by extruding a polymeric material to form an elongated panel. For example, a polymeric material may be fed into an extrusion process to provide an extruded member having contours that form the geometry of the siding panel 100, such as, for example, the first surface 150, second surface 160, fastening flange 114, upper vertical interlock 112, lower vertical interlock 122, or other features. The extruded member may then be cut into predetermined lengths to form the elongated siding panel 100.

In various embodiments, one or more of the features of the siding panel 100 may be molded, embossed, or machined into the siding panel 100. For example, first surface 150 or second surface 160 may be embossed on the extruded siding panel to provide aesthetically pleasing and decorative surfaces, or to provide functional surfaces; horizontally extending features such as the upper vertical interlock 112 or lower vertical interlock 122 may be machined into a surface of the extruded siding panel. One having ordinary skill in the art, having read this disclosure, will understand the various means for molding, embossing, or machining such features into an extruded siding panel.

In exemplary embodiments, the first horizontal interlock 200, and second horizontal interlock 300, may be formed in the siding panel 100 at the time of its manufacture. For example, the first groove 220 and first projection 210 may be molded, milled or sawed into a surface of the siding panel 100. Likewise, second groove 320 and second projection 310 may be molded, milled or sawed into a surface of the siding panel 100. One having ordinary skill in the art, having read this disclosure, will understand the various means for forming the horizontal interlocks 200, 300 into an extruded siding panel.

In other exemplary embodiments, the first horizontal interlock 200, and second horizontal interlock 300, may be formed in the siding panel 100 at the time that it is assembled or installed on a building surface. For example, an installer may use a custom saw to form one or both horizontal interlocks 200, 300 into the surface of a siding panel. One having ordinary skill in the art, having read this disclosure, will understand the various means for forming a horizontal interlock in a siding panel at the time of assembly or installation.

In exemplary embodiments, two or more siding panels 100 having horizontal interlock elements may be joined together to form a composite siding panel system 400. An installer may engage a first horizontal interlock 200 of a first siding panel 100, with a second horizontal interlock 300 of a horizontally adjacent siding panel. In exemplary embodiments, the horizontal interlocks 200, 300, provide a secure attachment between the adjacent siding panels, such as with a friction fit. In various embodiments, an installer may apply an adhesive or the like to improve the bond the two adjacent siding panels together at the interlock. A plurality of siding panels 100, 100*a* may be joined together in this way to provide a composite siding panel system 400 that has sufficient width to cover the entire building surface. Once fastened together, horizontally adjacent siding panels function as a single siding panel.

In exemplary embodiments, the composite siding panel system 400 may be installed horizontally by fastening the siding panel to the building surface. For example, an installer may insert fasteners through one or more fastener receiving holes or receiving grooves 116 in a fastening flange 114 into a building surface.

In exemplary embodiments, a plurality of composite siding panel systems 400 may be installed adjacent each other in horizontal rows. In exemplary embodiments, an installer fastens a first composite siding panel system 400 at the bottom of the building surface. The installer then fastens a second composite siding panel system 400 adjacent to and above the first composite siding panel. In exemplary embodiments, the installer engages a lower vertical interlock 122 on the second composite siding panel, with an upper vertical interlock 112 on the first composite siding panel, to properly align the vertically adjacent composite siding panel systems. A plurality of composite siding panel systems 400 are assembled in this way, until the vertical extent of the building surface is covered.

In exemplary embodiments, an installer covers the vertical ends 430, 440 of the composite siding panel systems 400 with a decorative end piece 500. In exemplary embodiments, the decorative end piece extends in a direction orthogonal to the composite siding panel system 400, and overlaps the end portion of the composite siding panel system 400. In exemplary embodiments, the decorative end piece covers the ends 430, 440 of a plurality of vertically adjacent composite siding panel systems 400. The decorative end piece 500 may extend the full height of the building surface, or may be combined with another piece to cover the full height of the building surface. The decorative end piece 500 may be configured to cover the corner of a building. For example, the composite siding panel systems 400 may be used to cover two building surfaces which intersect at a corner. In this instance, the composite siding panel system 400 terminates adjacent the corner, and a decorative corner piece may installed around the corner of the building to cover the ends 430, 440 of both sets of composite siding panels.

In the preceding specification, various preferred exemplary embodiments have been described with reference to the accompanying drawings. It will, however, be evident that various modifications and changes may be made thereto, and additional exemplary embodiments may be implemented, without departing from the broader scope of the invention as set forth in the claims that follow. The specification and drawings are accordingly to be regarded in an illustrative rather than restrictive sense.

What is claimed is:

1. A siding panel system of a building comprising:

a pair of panels in a first panel row coupled at adjacent vertical ends with outer faces of the panels together providing a substantially planar first panel row outer surface with an outer seam portion;

a first panel of the pair having on a vertical end an integrally formed first interlock including a first projection adjacent a first receiving groove at said outer seam portion;

a second panel of the pair having on a vertical end adjacent to the vertical end of the first panel a corresponding integrally formed second interlock including a second receiving groove and second projection mated to the first projection and first receiving groove, wherein the second interlock forms an inward seam portion in an inward surface opposite from the substantially planar first panel row outer surface and the inward seam portion is offset from linear alignment with the outer seam portion;

wherein upper horizontal portions of the first and second panels are coupled to an underlying building surface such that the first and second panels undergo horizontal first panel row movement as a single unit during shifting, contraction or expansion; and an end piece coupled to a building and covering a vertical edge of one of the first and second panels opposite the vertical end at the inner or outer seam portion wherein the vertical edge is free to move horizontally as an end of the row behind the end piece.

2. The siding panel system of claim 1, further comprising:

a second panel row of a plurality of panels coupled to the underlying building surface vertically adjacent to said first panel row with the outer faces of the plurality of panels in the second panel row together providing a substantially planar second panel row outer surface and the second row horizontally interlocked along horizontal edges to adjacent horizontal edges of the pair of panels in the first panel row allowing said first panel row movement and disposing the second panel row outer surface in a substantially parallel and different plane from the first panel row outer surface.

3. The siding panel system of claim 1, wherein the end piece is a corner end piece of a building.

4. The siding panel system of claim 1, wherein the end piece is a window trim piece.

5. The siding panel system of claim 1, wherein the end piece is a door trim piece.

6. The siding panel system of claim 1, wherein at least one of the first and second panels has opposite vertical ends that have complementary interlocking shapes.

7. A siding panel system of a building comprising:

a pair of panels in a first panel row coupled at adjacent vertical ends with outer faces of the panels together providing a substantially planar first panel row outer surface with an outer seam portion;

a first panel of the pair having on a vertical end an integrally formed first interlock including a first projection adjacent a first receiving groove at said outer seam portion;

a second panel of the pair having on a vertical end adjacent to the vertical end of the first panel a corresponding integrally formed second interlock including a second receiving groove and second projection mated to the first projection and first receiving groove, wherein the second interlock forms an inward seam portion in an inward surface opposite from the substantially planar first panel row outer surface and the inward seam portion is offset from linear alignment with the outer seam portion;

wherein upper horizontal portions of the first and second panels are coupled to an underlying building surface such that the first and second panels undergo horizontal first panel row movement as a single unit during shifting, contraction or expansion; and an end piece coupled to a building and covering a vertical edge of one of the first and second panels opposite the vertical end at the inner or outer seam portion wherein the vertical edge is free to move horizontally as an end of the row behind the end piece;

a second panel row of a plurality of panels coupled to the underlying building surface vertically adjacent to said first panel row with the outer faces of the plurality of panels in the second panel row together providing a substantially planar second panel row outer surface and the second row horizontally interlocked along horizontal edges to adjacent horizontal edges of the pair of panels in the first panel row allowing said first panel row movement and disposing the second panel row outer surface in a substantially parallel and different plane from the first panel row outer surface wherein the second row panels undergo horizontal second panel row movement as a single unit independent of the first panel row during shifting, contraction or expansion.

8. A siding panel system of a building comprising:

a pair of panels in a first panel row coupled at adjacent vertical ends with outer faces of the panels together providing a substantially planar first panel row outer surface with an outer seam portion;

a first panel of the pair having on a vertical end an integrally formed first interlock including a first projection adjacent a first receiving groove at said outer seam portion;

a second panel of the pair having on a vertical end adjacent to the vertical end of the first panel a corresponding integrally formed second interlock including a second receiving groove and second projection mated to the first projection and first receiving groove, wherein the second interlock forms an inward seam portion in an inward surface opposite from the substantially planar first panel row outer surface and the inward seam portion is offset from linear alignment with the outer seam portion;

wherein upper horizontal portions of the first and second panels are coupled to an underlying building surface such that the first and second panels undergo horizontal first panel row movement as a single unit during shifting, contraction or expansion; and an end piece and a spacer coupled to a building, wherein the spacer is disposed between the end piece and the building, and the end piece covers a vertical edge of one of the first and second panels opposite the vertical end at the inner or outer seam portion wherein the vertical edge is free to move horizontally as an end of the row behind the end piece.

9. The siding panel system of claim 8, wherein the end piece is a corner end piece of a building.

10. The siding panel system of claim 8, wherein the end piece is a window trim piece.

11. The siding panel system of claim 8, wherein the end piece is a door trim piece.

12. The siding panel system of claim 8, wherein at least one of the first and second panels has opposite vertical ends that have complementary interlocking shapes.

13. The siding panel system of claim 8, further comprising a second panel row of a plurality of panels coupled to the underlying building surface vertically adjacent to said first panel row with the outer faces of the plurality of panels in the second panel row together providing a substantially planar second panel row outer surface and the second row horizontally interlocked along horizontal edges to adjacent horizontal edges of the pair of panels in the first panel row allowing said first panel row movement and disposing the second panel row outer surface in a substantially parallel and different plane from the first panel row outer surface.

14. A siding panel system of a building comprising:

a pair of panels in a first panel row coupled at adjacent vertical ends with outer faces of the panels together providing a substantially planar first panel row outer surface with an outer seam portion;

a first panel of the pair having on a vertical end an integrally formed first interlock including a first projection adjacent a first receiving groove at said outer seam portion;

a second panel of the pair having on a vertical end adjacent to the vertical end of the first panel a corresponding integrally formed second interlock including a second receiving groove and second projection mated to the first projection and first receiving groove, wherein the second interlock forms an inward seam portion in an inward surface opposite from the substantially planar first panel row outer surface and the inward seam portion is offset from linear alignment with the outer seam portion; and a second panel row of a plurality of panels coupled to the underlying building surface vertically adjacent to said first panel row with the outer faces of the plurality of panels in the second panel row together providing a substantially planar second panel row outer surface and the second row horizontally interlocked along horizontal edges to adjacent horizontal edges of the pair of panels in the first panel row allowing said first panel row movement and disposing the second panel row outer surface in a substantially parallel and different plane from the first panel row outer surface;

wherein upper horizontal portions of the first and second panels are coupled to an underlying building surface such that the first and second panels undergo horizontal first panel row movement as a single unit during shifting, contraction or expansion; and wherein the second row panels undergo horizontal second panel row movement as a single unit independent of the first panel row during shifting, contraction or expansion.

* * * * *